US005632264A

United States Patent [19]

Barker et al.

[11] Patent Number: 5,632,264

[45] Date of Patent: May 27, 1997

[54] SPRING AIR GUN WITH PIVOTING BARREL

[75] Inventors: Kenton H. Barker, Penfield; Michael Cinquino, Livonia; David C. Snyder, Palmyra, all of N.Y.

[73] Assignee: Crosman Corporation, East Bloomfield, N.Y.

[21] Appl. No.: 486,833

[22] Filed: Jun. 7, 1995

[51] Int. Cl.[6] ..... F41B 11/14; F41B 11/20

[52] U.S. Cl. ..... 124/67

[58] Field of Search ..... 124/65, 66, 67, 124/68

[56] References Cited

U.S. PATENT DOCUMENTS

| | | | |
|---|---|---|---|
| 578,820 | 3/1897 | Hornhauer | 124/67 |
| 2,194,142 | 3/1940 | Foss | 124/67 |
| 4,367,723 | 1/1983 | Resuggan | 124/67 |
| 4,774,929 | 10/1988 | Milliman | 124/76 |
| 4,883,042 | 11/1989 | Wackrow | 124/67 |
| 5,160,795 | 11/1992 | Milliman | 42/65 |
| 5,205,271 | 4/1993 | Salva | 124/66 |
| 5,285,766 | 2/1994 | Milliman | 124/72 |
| 5,341,790 | 8/1994 | Ebert | 124/69 |

FOREIGN PATENT DOCUMENTS

| | | | |
|---|---|---|---|
| 468012 | 6/1914 | France | 124/67 |
| 714832 | 11/1941 | Germany | 124/67 |
| 20598 | of 1895 | United Kingdom | 124/67 |
| 12763 | of 1896 | United Kingdom | 124/67 |
| 11557 | of 1906 | United Kingdom | 124/67 |

*Primary Examiner*—John A. Ricci

[57] ABSTRACT

A gun with a pivoting barrel includes a compression tube having a forked front end and a fork member which is inserted into the front end of the compression tube. The fork member includes a cylindrical body which is inserted into the compression tube and a pair of forked arms which extend along the inside of the forked end of the compression tube. A barrel is pivotably connected to the forked ends of the fork member and the compression tube. A spring clip on the barrel engages a stud on the fork member for releasably retaining the barrel in a firing position. A cocking lever connected to the barrel is engageable with a trigger extension for preventing the trigger from being pulled when the barrel is not in the firing position.

10 Claims, 5 Drawing Sheets

FIG. 13
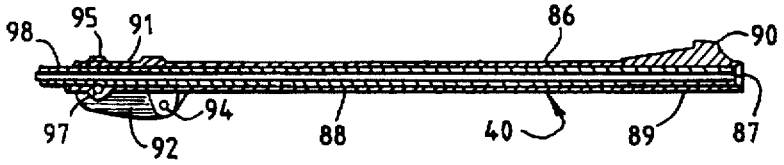
FIG. 14
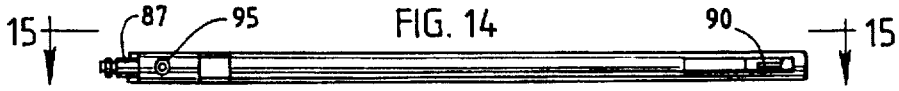
FIG. 15
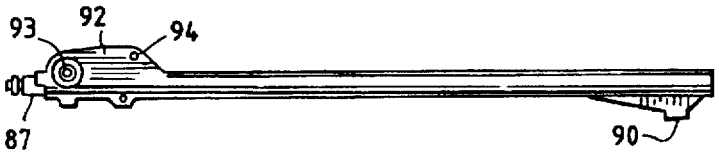
FIG. 17
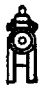
FIG. 16
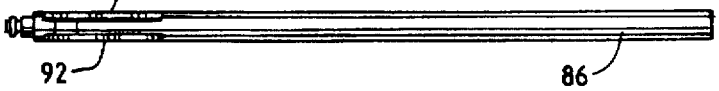
FIG. 18
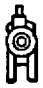
FIG. 19
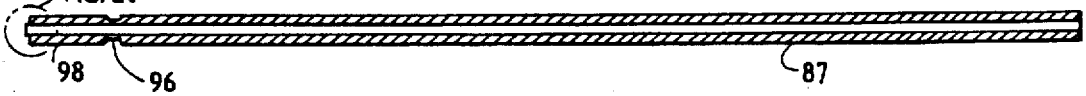
FIG. 20
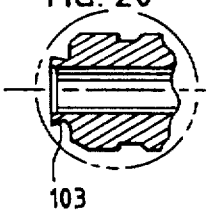
FIG. 21
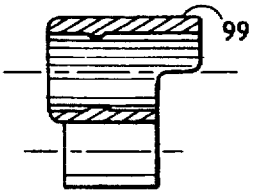
FIG. 22
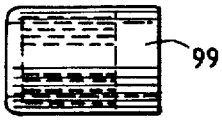
FIG. 23
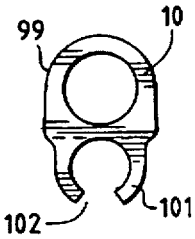
FIG. 24
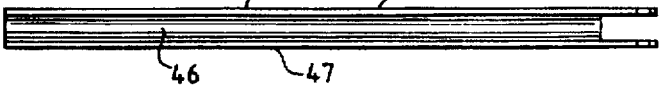
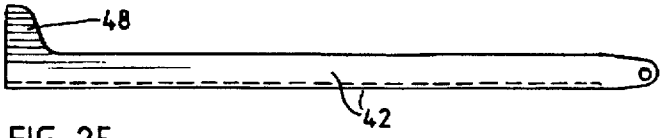
FIG. 25
FIG. 26
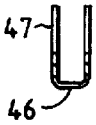

FIG. 27
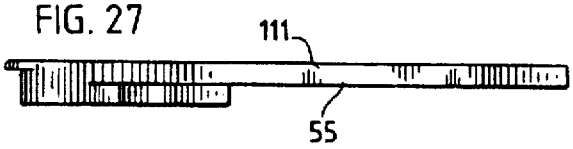
FIG. 28
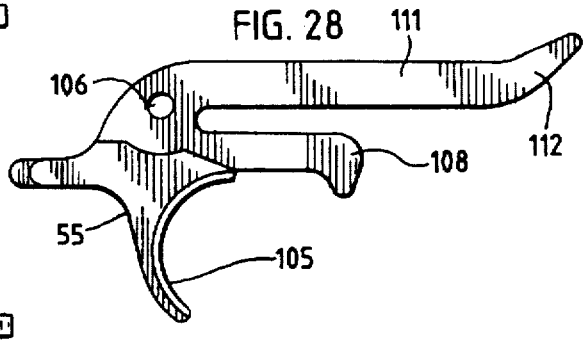
FIG. 29
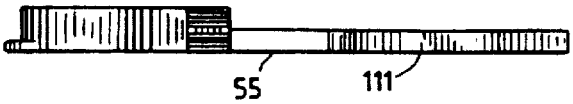
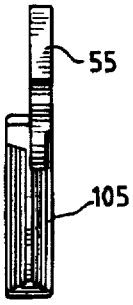
FIG. 30
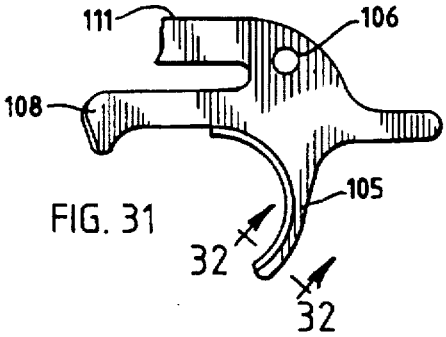
FIG. 31
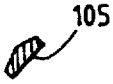
FIG. 32
FIG. 33
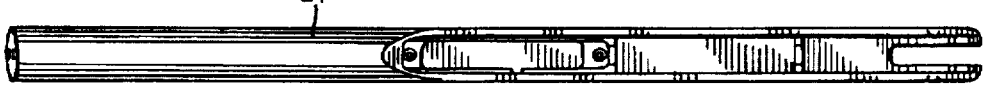
FIG. 34
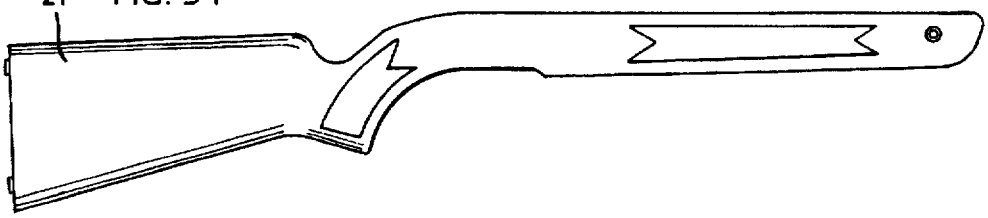

FIG. 35
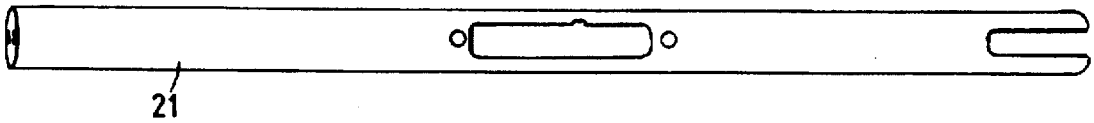
FIG. 36
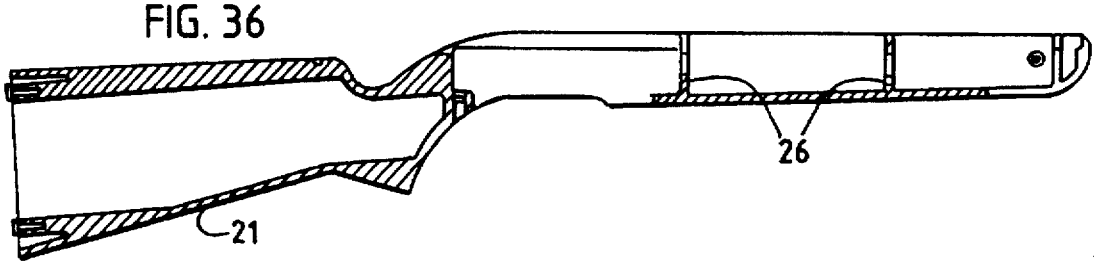
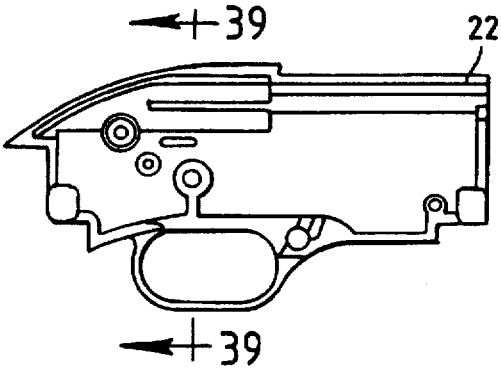
FIG. 37
FIG. 38
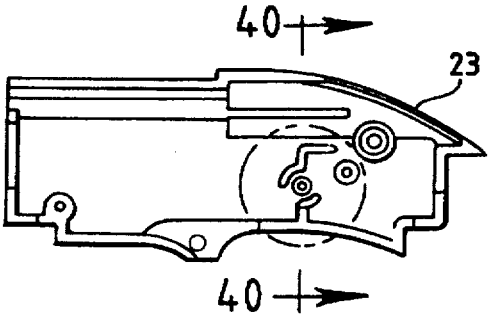
FIG. 39
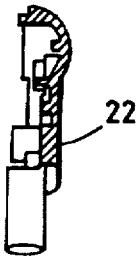
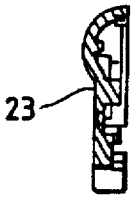
FIG. 40

SPRING AIR GUN WITH PIVOTING BARREL

BACKGROUND AND SUMMARY

This invention relates to a spring air gun with a pivoting barrel. More particularly, the invention relates to such a gun with an improved fork member for pivotably mounting the barrel and for retaining the barrel in a firing position and a safety mechanism for preventing the gun to be fired when the barrel is not in the firing position.

A spring air gun generally includes a barrel for holding a projectile, a compression tube, and a spring-biased piston reciprocably mounted in the compression tube. The gun is cocked for firing by moving the piston to compress the spring. When the gun is fired, the spring drives the piston to compress the air within the compression tube, which propels the projectile from the barrel.

Spring air guns commonly include a pivoting barrel which is connected to a cocking lever for cocking the piston when the barrel is pivoted away from its firing position. As described in U.S. Pat. No. 5,205,271, the barrel is advantageously pivotably mounted in a fork member which is inserted into the compression tube.

The invention provides an improvement over the gun which is described in the patent. A single dowel pin attaches the fork member to the compression tube. The compression tube is also forked, and the fork of the compression tube engages and reinforces the outside of the fork member. The barrel is pivotally connected to both of the forks by a single dowel pin. A spring clip on the barrel releasably engages a stud on the fork member to retain the barrel in the firing position. The butt stock of the gun is attached to the fork member by screws which threadedly engage internally threaded inserts in the fork member. A trigger blocking mechanism engages the cocking lever when the barrel is not in the firing position and prevents the trigger from being pulled.

DESCRIPTION OF THE DRAWING

The invention will be explained in conjunction with an illustrative embodiment shown in the accompanying drawing, in which

FIG. 13 is a sectional view of the barrel assembly;

FIG. 14 is a top view of the barrel assembly;

FIG. 15 is a side view of the barrel assembly taken along the line 15—15 of FIG. 14;

FIG. 16 is a bottom view of the barrel assembly;

FIG. 17 is a left end view of the barrel assembly;

FIG. 18 is right end view of the barrel assembly;

FIG. 19 is an enlarged sectional view of the barrel insert;

FIG. 20 is an enlarged fragmentary sectional view of the breech end of the barrel insert;

FIG. 21 is a sectional view of the detent clip for the barrel assembly;

FIG. 22 is a top view of the detent clip;

FIG. 23 is a right end view of the detent clip;

FIG. 24 is a top view of the cocking lever;

FIG. 25 is a side view of the cocking lever;

FIG. 26 is a right end view of the cocking lever;

FIG. 27 is a top view of the trigger;

FIG. 28 is a side view of the trigger;

FIG. 29 is a bottom view of the trigger;

FIG. 30 is a right end view of the trigger;

FIG. 31 is a fragmentary left side view of the trigger;

FIG. 32 is a sectional view taken along the line 32—32 of FIG. 31;

FIG. 33 is a top view of the stock;

FIG. 34 is a side view of the stock;

FIG. 35 is a bottom view of the stock;

FIG. 36 is a sectional view of the stock;

FIG. 37 is a right side view of the left hand receiver;

FIG. 38 is a left side view of the right hand receiver;

FIG. 39 is a sectional view taken along the line 39—39 of FIG. 37; and FIG. 40 is a sectional view taken along the line 40—40 of FIG. 38.

DESCRIPTION OF SPECIFIC EMBODIMENT

Figure 1:
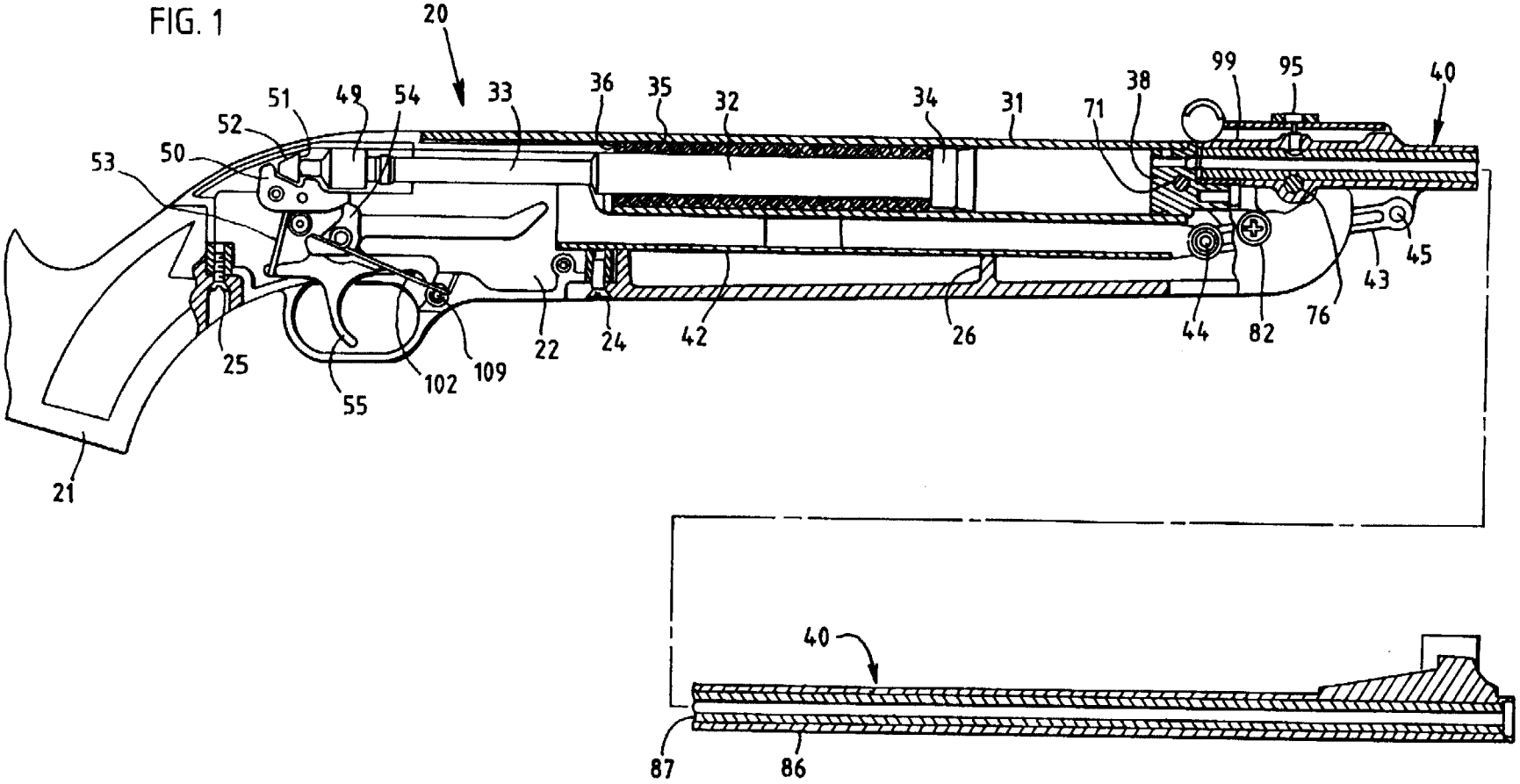
FIG. 1 is a side elevational view, partially broken away, of a gun formed in accordance with the invention.
Figure 2:
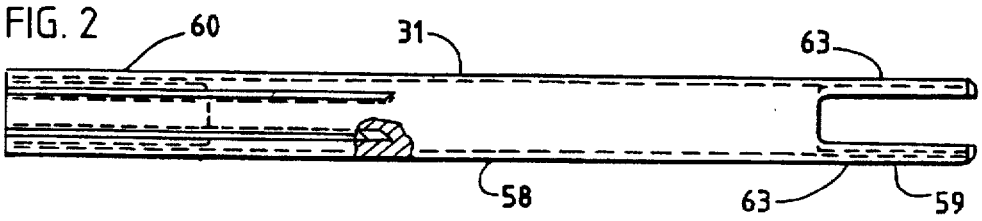
FIG. 2 is a top view, partially broken away, of the compression tube.
Figure 3:
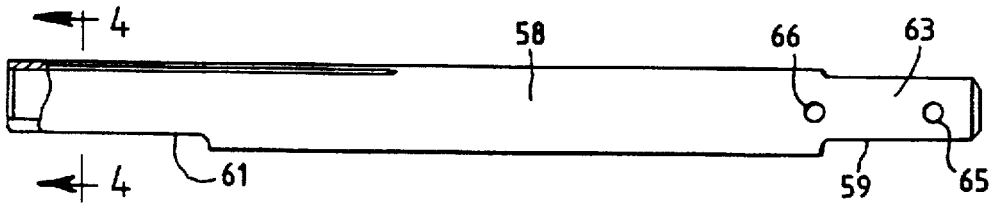
FIG. 3 is a side elevational view, partially broken away, of the compression tube.
Figure 4:
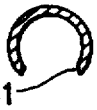
FIG. 4 is a sectional view taken along the line 4—4 of FIG. 3.
Figure 5:
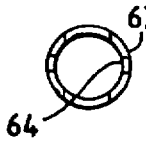
FIG. 5 is a right end view of the compression tube.
Figure 6:
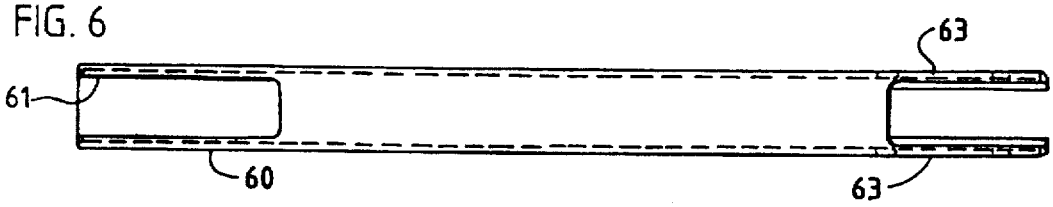
FIG. 6 is a bottom view of the compression tube.
Figure 7:
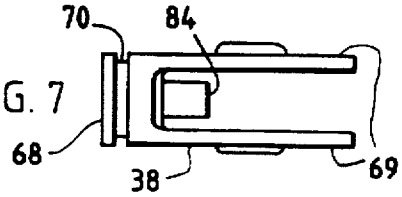
FIG. 7 is a top view of the fork member.
Figure 8:
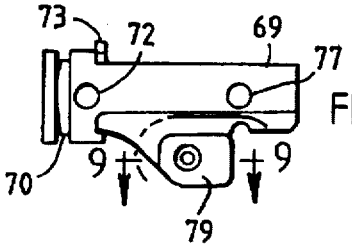
FIG. 8 is a side view of the fork member.
Figure 9:
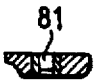
FIG. 9 is a sectional view taken along the line 9—9 of FIG. 8.
Figure 10:
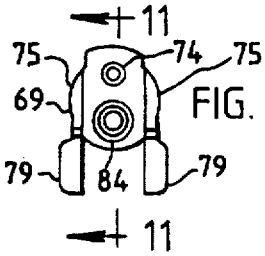
FIG. 10 is a right end view of the fork member.
Figure 11:
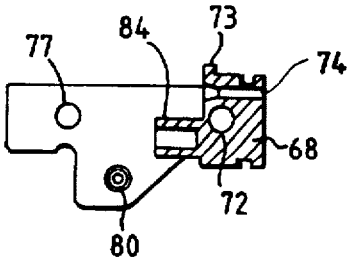
FIG. 11 is a sectional view taken along the line 11—11 of FIG. 10.
Figure 12:
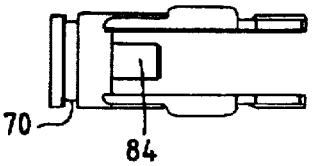
FIG. 12 is a bottom view of the fork member.

Referring first to FIGS. 1 and 33–40, a gun 20 includes a frame comprising a stock 21 and a receiver formed from right and left hand receivers 22 and 23. The right and left hand receivers are bolted together in the conventional manner, and the left hand receiver is secured to the stock by screws 24 and 25.

A compression tube 31 is mounted on the receiver, and a piston 32 is reciprocable within the compression tube. The piston includes a piston rod 33 and a radially enlarged piston head 34. A compression spring 35 engages the piston head and resiliently biases the piston to the right. The left end of the compression spring engages a washer 36 which is anchored within the rear end of the compression tube.

A fork member 38 is secured within the forward end of the compression tube and will be described more fully hereinafter.

A barrel assembly 40 is pivotably mounted on the fork member and is pivotable between a firing position which is illustrated in FIG. 1 and a cocking position.

A cocking lever 42 is slidably supported by the stock 21 and is connected to the barrel by a link 43. The link is pivotably connected to the lever and the barrel by pins 44 and 45.

Referring to FIGS. 24–26, the cocking lever 42 is generally channel-shaped and includes a bottom wall 46 and a pair of side walls 47. The rear ends of the side wall include upwardly extending pusher arms 48.

The gun is cocked by pivoting the barrel clockwise from the firing position of FIG. 1. The cocking lever moves rearwardly, i.e. toward the person cocking the weapon or to the left (in FIG. 1), and the pusher arms 48 engage an annular flange 49 on the piston rod 33 and slide the piston rearwardly against the force of compression spring 35. The piston is latched in the cocked position shown in FIG. 1 by a sear 50 which engages an annular shoulder 51 on the piston rod. The cocking lever is slidably supported by ribs 26 on the stock 21.

The shoulder 51 is in front of a flared camming surface 52 which engages the sear and rotates the sear counterclockwise into the latching position as the piston moves rearwardly. A sear spring 53 biases the sear to rotate clockwise, and the sear is retained in the latching position by a cam 54 on trigger 55.

The gun is fired by pulling the trigger, which rotates the cam 54 clockwise out of engagement with the sear 50. The sear spring rotates the sear out of engagement with the shoulder 51, and the compression spring 35 forces the piston forwardly at high speed. The rapidly moving piston compresses the air in the compression tube and forces the compressed air through an opening in the fork member 38. A projectile within the barrel is propelled out of the barrel by high velocity air which flows through the opening in the fork member.

Referring to FIGS. 2–6, the compression tube 31 includes a cylindrical central portion 58, a forked front portion 59, and a rear portion 60 which is provided with a recess 61 in the bottom. The forked front portion includes a pair of arms 63. Each of the arms has an arcuate cross section and a concave inside surface 64. An opening 65 is provided through each of the arms, and openings 66 are provided at the junction of the arms and the cylindrical portion 58.

The compression tube is advantageously formed from carbon steel tubing.

Referring now to FIGS. 7–12, the fork member 38 includes a cylindrical body or plug 68 and a pair of arms 69. The cylindrical body is sized to fit snugly within the front end of the cylindrical portion of the compression tube. An O-ring fits into an annular groove 70 in the body and provides an airtight seal between the body and the compression tube. The fork member is secured to the compression tube by a single dowel pin 71 (FIG. 1) which extends through an opening 72 in the body of the fork member and the openings 66 in the compression tube. A stop shoulder 73 on top of the body engages the front edge of the cylindrical portion of the compression tube.

An orifice 74 is provided in the body of the fork member to allow compressed air to flow out of the compression tube. Each end of the orifice is flared.

Each of the arms 69 of the fork member includes an arcuate or convex outer surface 75 (FIG. 10) which mates with and engages a concave inner surface 64 of one of the arms 63 of the compression tube. The metal arms 63 reinforce the arms of the fork member and provide a stiffer and more secure mounting for the barrel than previous fork members.

The barrel assembly 40 is pivotably mounted between the arms 69 of the fork member by a dowel pin 76 (FIG. 1) which extends through openings 77 in the arms 69 and the openings 65 in the arms 63.

A lug 79 extends downwardly from each of the arms 69. An internally threaded insert or bushing 80 (FIG. 11) is inserted into an opening 81 in the lug and is ultrasonically welded in place. The stock 28 is secured to the inserts by screws 82 (FIG. 1).

A generally cylindrical stud 84 extends forwardly from the body of the fork member between the arms 69. As will be explained hereinafter, the stud maintains the barrel in the firing position.

The fork member is advantageously molded integrally from glass filled nylon plastic.

The barrel 40 includes a molded plastic barrel housing 86 (FIGS. 1 and 15–18) and a steel tubular barrel insert 87 which is insert molded within the housing. The barrel housing includes an elongated tubular central portion 88, a front end portion 89 which includes a sight 90, and a rear end portion 91 which includes a pair of spaced-apart mounting flanges 92. The mounting block is provided with openings 93 for the dowel pin 76 which pivotably mounts the barrel assembly within the fork member and openings 94 for the pin 45 which attaches the link 43. The dowel pin 76 which pivotally mounts the barrel assembly extends through an annular groove 96 (FIG. 19) in the barrel insert and through a concave groove 97 (FIG. 13) in the bore of the barrel housing.

The rear end or breech end 98 of the barrel insert extends beyond the barrel housing, and a detent clip 99 (FIGS. 21–23) is mounted on the exposed end of the barrel insert. The detent clip includes a cylindrical collar 100 which fits snugly over the breech end of the barrel and a pair of curved arms or clips 101 which are separated by an open mouth 102.

The detent clip is molded integrally from plastic such as Delrin. The molded plastic arms 101 are flexible and resilient and provide a spring retaining clip for maintaining the barrel in the firing position in which the bore of the metal barrel insert 87 is aligned with the orifice 74 of the fork member.

The open mouth 101 of the detent clip is narrower than the diameter of the stud 84 of the fork member. As the barrel is rotated counterclockwise toward the firing position, the arms of the detent clip are cammed open by the cylindrical stud and then snap back around the stud to retain the barrel in the firing position. The curvature of the arms 101 is substantially the same as the curvature of the stud, and the spring clip holds the barrel in alignment with the orifice 74 of the fork member. Referring to FIG. 20, the breech end of the barrel insert includes an outwardly flared or frusto-conical extension 103 which retains an O-ring for sealing against the fork member. When the barrel is rotated clockwise to move the cocking lever 42, the arms of the spring clip spread apart and pass over the stud 84.

Referring to FIGS. 27–32, the trigger 55 includes a curved finger portion 105 and a pivot opening 106 for a pin which pivotally mounts the trigger in the receiver. A trigger spring 107 and the cam 54 (FIG. 1) are also mounted on the trigger pin. A safety extension 108 extends forwardly from the finger portion for engaging a safety lock 109 (FIG. 1) which prevents rotation of the trigger when the safety lock is on.

A trigger extension rod 111 extends forwardly beyond the finger portion toward the cocking lever 42, (FIG. 1). The extension rod terminates in an upwardly angled end 112.

When the barrel is in the firing position of FIG. 1, the rear end of the cocking lever 42 is spaced forwardly of the end of the trigger extension rod 111, and the trigger and extension rod can rotate clockwise to fire the gun. However, if the barrel is not in the firing position, the cocking lever will be moved to the left of its FIG. 1 position and will be engageable with the trigger extension rod to prevent the trigger from being pulled.

The gun which is described herein has fewer components than comparable prior art guns and is therefore cheaper and easier to assemble. Fewer components also means improved reliability.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A gun comprising:

a frame, a compression tube mounted on the frame and having front and rear ends, a fork member mounted on the front end of the compression tube, the fork member including a generally cylindrical body which is inserted into the compression tube and a pair of spaced-apart arms which extend forwardly from the body, the body having a bore which communicates with the compression tube, a barrel assembly pivotably mounted between the arms and movable between a firing position in which teh barrel assembly is aligned with the bore of the body of the fork member and a cocking position, the barrel assembly including a resilient spring clip which is engageable with the fork member to releasably retain the barrel assembly in the firing position, the fork member including a stud extending forwardly of the cylindrical body and located between the arms, the stud being engageable with the spring clip of the barrel assembly, the stud being generally cylindrical and the spring clip including a pair of curved spring arms which extend around portions of the stud when the barrel assembly is in the firing position.

2. A gun comprising:

a frame, a compression tube mounted on the frame and having front and rear ends, a fork member mounted on the front end of the compression tube, the fork member including a generally cylindrical body which is inserted into the compression tube and a pair of spaced-apart arms which extend forwardly from the body, the body having a bore which communicates with the compression tube, and a barrel assembly pivotably mounted between the arms and movable between a firing position in which the barrel assembly is aligned with the bore of the body of the fork member and a cocking position, the barrel assembly including a resilient spring clip which is engageable with the fork member to releasably retain the barrel assembly in the firing position, the barrel including a molded plastic barrel housing and a barrel tube within the barrel housing and including a breech end which extends beyond the barrel housing, the spring clip being mounted on the breech end of the barrel tube.

3. A gun comprising:

a frame, a compression tube mounted on the frame and having front and rear ends, a fork member mounted on the front end of the compression tube, the fork member including a generally cylindrical body which is inserted into the compression tube and pair of spaced-apart arms which extend forwardly from the body, the body having a bore which communicates with the compression tube, and a barrel assembly pivotably mounted between the arms and movable between a firing position in which the barrel assembly is aligned with the bore of the body of the fork member and a cocking position, the barrel assembly including a resilient spring clip which is engageable with the fork member to releasably retain the barrel assembly in the firing position, each of the arms of the fork member including an attaching portion and the frame includes a butt, the butt being attached to the attaching portions of the arms of the fork member by screws which threadedly engage the attaching portions.

4. The gun of claim 3 in which each of the attaching portions includes an internally threaded insert which is threadedly engaged with one of the screws.

5. A gun comprising:

a frame, a compression tube mounted on the frame and having front and rear ends, a fork member mounted on the front end of the compression tube, the fork member including a generally cylindrical body which is inserted into the compression tube and a pair of spaced-apart arms which extend forwardly from the body, the body having a bore which communicates with the compression tube, and a barrel assembly pivotably mounted between the arms and movable between a firing position in which the barrel assembly is aligned with the bore of the body of the fork member and a cocking position, the barrel assembly including a resilient spring clip which is engageable with the fork member to releasably retain the barrel assembly in the firing position, the front end of the compression tube including a pair of spaced-apart arms which extend forwardly alongside the arms of the fork member.

6. The gun of claim 5 in which each of the arms of the fork member includes a convex outer surface and each of the arms of the compression tube includes a concave inner surface which engages the convex outer surface of one of the arms of the fork member.

7. A gun comprising:

a frame, a compression tube mounted on the frame and having front and rear ends, a fork member mounted on the front end of the compression tube, the fork member including a generally cylindrical body which is inserted into the compression tube and a pair of spaced-apart arms which extend forwardly from the body, the body having a bore which communicates with the compression tube, a barrel pivotably mounted between the arms and movable between a firing position in which the barrel is aligned with the bore of the body of the fork member and a cocking position, a piston mounted in the compression tube for reciprocation between a cocked position and a fired position, a spring engaging the piston and biasing the piston toward the fired position, a cocking lever connected to the barrel and engageable with the piston, the cocking lever being movable between a firing position when the barrel is in the firing position and a cocking position when the barrel is in the cocking position, a trigger movably mounted on the frame for movement between a rest position and a firing position, the trigger including a trigger extension member which is engageable with the cocking lever when the cocking lever is between the firing position and the cocking position for preventing the trigger from moving from the rest position to the firing position, each of the arms of the fork member including an attaching portion and the frame including a butt mounted on the frame, the butt being attached to the attaching portions of the arms of the fork member by screws which threadedly engage the attaching portions.

8. The gun of claim 7 in which the front end of the compression tube includes a pair of spaced-apart arms which extend forwardly alongside the arms of the fork member.

9. A gun comprising:

a frame, a compression tube mounted on the frame and having front and rear ends, the front end of the compression tube including a pair of forwardly extending spaced-apart arms, each of the arms of the compression tube having a concave inner surface, a fork member mounted on the front end of the compression tube, the fork member including a generally cylindrical body which is inserted into the compression tube and a pair of spaced-apart arms which extend forwardly from the body, the body having a bore which communicates with the compression tube, each of the arms of the fork member including a convex outer surface which engages the concave inner surface of one of the arms of the compression tube, and a barrel pivotably mounted between the arms of the fork member.

10. The gun of claim 9 including a pin which extends through openings in the arms of the compression tube and the fork member and an opening in the barrel for pivotably connecting the barrel to the arms of the fork member and the compression tube.

* * * * *

UNITED STATES PATENT AND TRADEMARK OFFICE

CERTIFICATE OF CORRECTION

PATENT NO. : 5,632,264

DATED : May 27, 1997

INVENTOR(S) : Kenton H. Barker et al

It is certified that error appears in the above-indentified patent and that said Letters Patent is hereby corrected as shown below:

Col. 5, line 17 change "teh" to --the--.

Signed and Sealed this

Second Day of September, 1997

*Attest:*

*Attesting Officer*

BRUCE LEHMAN

*Commissioner of Patents and Trademarks*